United States Patent [19]

Hoekstra et al.

[11] 4,353,418

[45] Oct. 12, 1982

[54] IN SITU RETORTING OF OIL SHALE

[75] Inventors: Gerald B. Hoekstra, South Holland; David R. Christian, Lisle, both of Ill.

[73] Assignees: Standard Oil Company (Indiana); Gulf Oil Corporation, both of Chicago, Ill.

[21] Appl. No.: 198,850

[22] Filed: Oct. 20, 1980

[51] Int. Cl.[3] ..... E21B 43/247; E21B 43/34; E21B 43/38

[52] U.S. Cl. ..... 166/259; 166/261; 166/267; 208/11 R

[58] Field of Search ..... 166/244 C, 256, 259, 166/261, 266, 267, 251; 299/2; 208/11 R

[56] References Cited

U.S. PATENT DOCUMENTS

| | | | |
|---|---|---|---|
| 2,370,507 | 2/1945 | Teichmann et al. | 166/266 |
| 2,474,345 | 6/1949 | Clark et al. | 208/11 R |
| 3,139,928 | 7/1964 | Broussard | 166/261 |
| 3,228,467 | 1/1966 | Schlinger et al. | 166/266 |
| 3,233,668 | 2/1966 | Hamilton et al. | 166/259 |
| 3,617,470 | 11/1971 | Schlinger et al. | 208/11 R |
| 3,794,116 | 2/1974 | Higgins | 166/259 |
| 4,010,092 | 3/1977 | Deering | 208/11 R |
| 4,026,357 | 5/1977 | Redford | 166/261 |
| 4,036,299 | 7/1977 | Cha et al. | 166/261 |
| 4,043,897 | 8/1977 | Deering | 208/11 R |
| 4,087,130 | 5/1978 | Garrett | 166/261 X |
| 4,117,886 | 10/1978 | Honaker | 166/261 X |
| 4,153,540 | 5/1979 | Gorring | 208/89 |
| 4,169,506 | 10/1979 | Berry | 166/256 |
| 4,263,970 | 4/1981 | Cha | 166/261 |
| 4,284,139 | 8/1981 | Sweany | 166/267 |
| 4,306,965 | 12/1981 | Hensley, Jr. et al. | 208/216 PP |

*Primary Examiner*—James A. Leppink
*Assistant Examiner*—George A. Suchfield
*Attorney, Agent, or Firm*—Thomas W. Tolpin; William T. McClain; William H. Magidson

[57] ABSTRACT

Disclosed are a method and apparatus for the in situ retorting of oil shale and purification products comprising establishing an underground in situ retort containing a mass of rubblized matter comprising oil shale and establishing a flame front within the rubblized matter. Oxygen containing gas comprising at least about 90 weight percent oxygen and diluent are passed into the retort to support combustion and form combustion gases suitable for the retorting of the rubblized mass and formation of off-gas comprising hydrogen, hydrocarbons, and contaminants. Off-gas comprising hydrogen, hydrocarbons, and contaminants is recovered from the retort and hydrocarbons and contaminants are substantially separated from at least a portion of the off-gas to produce a purified gas stream comprising hydrogen. At least a portion of the purified gas stream is passed to one or more conversion zones wherein shale oil is contacted with a stream comprising purified gas stream in the presence of a conversion catalyst at conversion conditions so as to substantially reduce the amount of nitrogen and sulfur contained in the shale oil.

9 Claims, 1 Drawing Figure

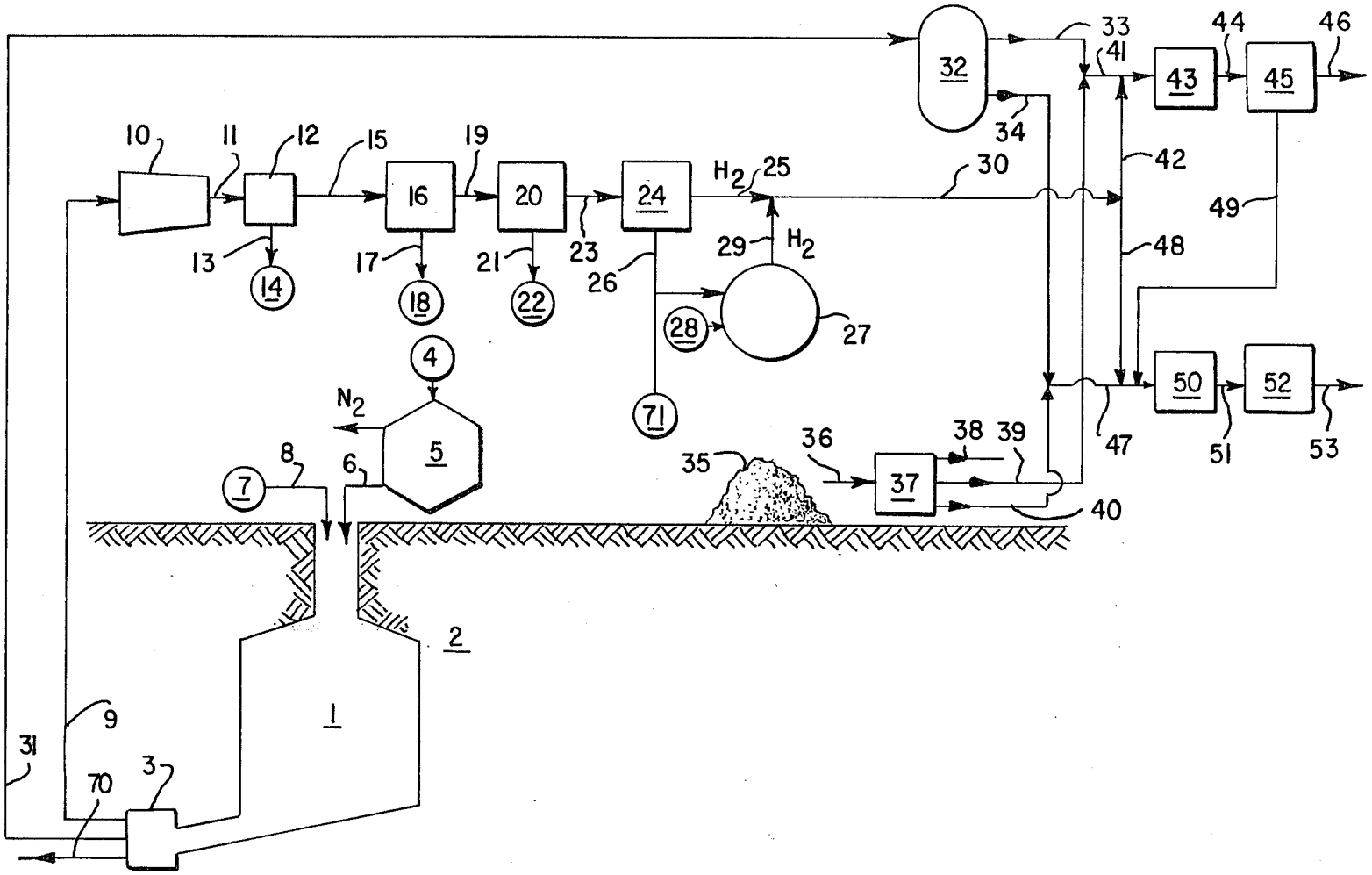
46
45
44
43
33
41
42
48
49
52
53
51
50
47
40
32
34
30
39
38
37
36
35
27
$H_2$
25
$H_2$
29
28
24
71
26
23
20
22
21
19
16
18
17
15
12
14
13
11
10
4
5
$N_2$
6
8
7
2
1
3
9
70
31

IN SITU RETORTING OF OIL SHALE

BACKGROUND

This invention relates to recovery of carbonaceous materials from underground deposits. More specifically, this invention relates to subsurface combustion and retorting of oil shale and the recovery and use of hydrogen recovered from combustion and retorting gases.

Numerous hydrocarbonaceous materials are found in underground deposits; for example crude oil, coal, shale oil, tar sands, and others. One method of recovering energy or hydrocarbon from such underground deposits is by underground combustion. An oxidizing gas such as air or oxygen can be provided to an underground combustion or retorting zone so as to combust a portion of the combustible material contained therein and free hydrocarbon or thereby form materials which are suitable for energy recovery. For example, air or oxygen, and diluent gases such as steam, can be passed into a coal deposit so as to form off-gases having combustible materials such as light hydrocarbons and carbon monoxide. These gases can then be combusted directly for heat, or energy recovered can be used in the recovery of petroleum crude oil from certain types of deposits. Air or oxygen, and steam, is passed into an underground deposit and combustion initiated so hot combustion gases will aid in the recovery of such crude oil. Similar technique can be used in the recovery of oil from tar sands. One important use of underground combustion is in the recovery of oil from oil shale.

The term "oil shale" refers to sedimentary deposits containing organic materials which can be converted to shale oil. Oil shale can be found in various places throughout the world, especially in the United States in Colorado, Utah, and Wyoming. Some especially important deposits can be found in the Green River formation in the Piceance Basin, Garfield and Rio Blanco counties, in Northwestern Colorado.

Oil shale contains organic material called kerogen which is a solid carbonaceous material from which shale oil can be produced. Commonly oil shale deposits have variable richness of kerogen content, the oil shale generally being stratified in horizontal layers. Upon heating oil shale to a sufficient temperature, kerogen is decomposed and liquids and gases are formed. These fluids contain heating values and comprise shale oil, carbon monoxide, carbon dioxide, hydrogen, light hydrocarbon gases, water, hydrogen sulfide, and others. Oil shale can be retorted to form a hydrocarbon liquid either by in situ or surface retorting. In surface retorting, oil shale is mined from the ground, brought to the surface, crushed, and placed in vessels where it is contacted with hot heat transfer medium, such as hot shale or gases, or mixtures thereof, for heat transfer. The resulting high temperatures cause shale oil to be freed from the oil shale forming a partially spent oil shale comprising inorganic material and carbonaceous material such as coke. The coke may be deposited on the surface of the shale particles and also within the shale particles. The carbonaceous material can be burned by contact with oxygen at oxidation temperatures to recover heat and to form a spent oil shale relatively free of carbon. Spent retorted oil shale which has been depleted in carbonaceous material is removed from the reactor and discarded. Some well-known methods of surface retorting are the Tosco, Lurgi, and Paraho processes and fluid bed retorting, among others.

Another method of retorting oil shale is the in situ process. In situ retorting of oil shale generally comprises forming a retort or retorting zone underground, preferably within the oil shale zone. The retorting zone can be formed by mining an access tunnel to or near the retorting zone and then removing a portion of the oil shale deposit by conventional mining techniques. About 2 to about 45 percent, preferably about 15 to about 40 percent, of the oil shale in the retorting area is removed to provide void space in the retorting area. The oil shale in the retorting area is then rubblized by well-known mining and blasting techniques to provide a retort containing rubblized shale for retorting. In some cases it is possible to rubblize underground oil shale without removal of a portion of the oil shale. However, it is generally preferable to remove material so as to provide void space which will result in more uniform rubblization and more efficient use of explosives.

A common method for forming the underground retort is to undercut the deposit to be retorted and remove a portion of the deposit to provide void space. Explosives are then placed in the overlying or surrounding oil shale. These explosives are used to rubblize the shale, preferably forming a zone of rubble having uniform particle size and void spaces. Some of the techniques used for forming the undercut area and the rubblized area are room and pillar mining, sublevel caving, crater retreat and the like. Because of the stratification of oil shale it may be desirable to selectively mine material based on its mineral or kerogen content for removal from the retorting zone. Also because of the stratification, the retorting zone may contain lean oil shale, or rock containing essentially no kerogen. After the underground retort is formed, the pile of rubblized shale is subjected to retorting. Hot retorting gases are passed through the rubblized shale to effectively form and recover liquid hydrocarbon from the oil shale. This can be done by passing a gas comprising air or air mixed with steam through the deposit. Air can be forced into one end of the retort and a fire or flame front initiated. Combustion can be initiated by introducing fuels such as natural gas, propane, shale oil, and the like which are readily combustible with air. After combustion has been initiated, it can be sustained by combusting coke on spent or partially spent oil shale, oxygen contacting the coke forming or maintaining a flame front. This flame front is then passed slowly through the rubblized deposit to effect retorting. Actually the hot combustion gases passing ahead of the flame front cause the retorting of oil shale and the formation of shale oil. The oil passes through a portion of the rubble within the retort, often as an oil mist. Another suitable retorting fluid comprises hot combustion or retorting off-gas from the same or nearby underground retort. Not only is shale oil effectively produced, but also a mixture of off-gases is produced during retorting. These gases contain hydrogen, carbon monoxide, ammonia, carbon dioxide, hydrogen sulfide, carbonyl sulfide, oxides of sulfur and nitrogen, and low molecular weight hydrocarbons. Generally a mixture of off-gas, water and shale oil are recovered from the retort. This mixture undergoes preliminary separation commonly by gravity to separate the gases from the liquid oil from the liquid water. The off-gases commonly also contain entrained dust, and hydrocarbons, some of which are liquid or liquefiable under moderate pressure. The off-gases commonly have a very low heat content, generally about 50 to about 150 BTU per cubic foot.

A number of patents describe methods of in situ retorting of oil shale, such as Karrick, L. C., U.S. Pat. No. 1,913,395; Karrick, S. N., U.S. Pat. No. 1,919,636; Uren, U.S. Pat. No. 2,481,051; Van Poollen, U.S. Pat. No. 3,001,776; Ellington, U.S. Pat. No. 3,586,377; Prats, U.S. Pat. No. 3,434,757; Garrett, U.S. Pat. No. 3,661,423; Ridley, U.S. Pat. No. 3,951,456; and Lewis, U.S. Pat. No. 4,017,119 which are hereby incorporated by reference and made a part hereof.

While some prior art processes teach the use of oxygen to support in situ combustion, most teach the use of air. Because air comprises substantial nitrogen, combustion and retorting off-gases are also contaminated with nitrogen, giving the off-gases a undesirably low BTU content from combustion, and making hydrogen recovery from the off-gas economically unattractive. Heat is also lost to the nitrogen in flue gas.

Berry, U.S. Pat. No. 4,169,506, teaches an in situ oil shale retorting process wherein off-gases are purified to remove oil, water, dust, and sulfur compounds such as hydrogen sulfide to prepare the off-gases for combustion and power generation.

Shale oil formed by retorting generally contains relatively high levels of sulfur and nitrogen compounds which can cause metal corrosion, product instability, etc. Gorring et al., U.S. Pat. No. 4,153,540 and Goldstein, U.S. Pat. No. 4,193,454 teach the hydrotreating and hydrocracking of shale oil in the presence of conversion catalysts.

It is an object of this invention to provide an improved method and apparatus for the in situ retorting of oil shale.

It is an object of this invention to provide a process which minimizes underground in situ retort off-gas contamination with nitrogen and minimizes the amount of heat lost in the flue gas.

It is further an object of this invention to purify retort off-gases, recover hydrogen from the off-gases for use in the upgrading of shale oil, and produce high BTU off-gas.

SUMMARY OF THE INVENTION

The objects of this invention can be attained by the disclosed method and apparatus, said method comprising establishing an underground in situ retort containing a mass of rubblized matter comprising oil shale and establishing a flame front within the rubblized matter. Oxygen containing gas comprising at least about 90 weight percent oxygen and diluent are passed into the retort to support combustion and form combustion gases suitable for the retorting of the rubblized mass and forming off-gas comprising hydrogen, hydrocarbons, and contaminants. Diluents such as steam or essential non-nitrogen containing gases are used to reduce the oxygen content of the gas mixture entering the retort to about 5 to about 25 weight percent oxygen. Off-gas comprising hydrogen, hydrocarbons, and contaminants is recovered from the retort and hydrocarbons and contaminants are substantially separated from at least a portion of the off-gas stream to produce a purified gas stream comprising hydrogen. At least a portion of the purified gas stream is passed to one or more conversion zones wherein shale oil is contacted with a stream comprising purified gas stream in the presence of a conversion catalyst at conversion conditions so as to substantially reduce the amount of nitrogen and sulfur contained in the shale oil.

The underground retorts can be horizontal or vertical, and of various shapes such as rectangular, cylindrical, elongated, or irregular. Retorting fluid can be passed into such retort in any direction such as upward, downward, sideways or transversely. It is preferred to use a vertical retort with hot retorting gases passed predominantly in a downward direction so that shale oil formed, often in mist form, and also coalesced oil on rubble, can pass essentially downwardly aided by gravity and gas flow.

The oxygen containing gas comprises at least about 90 weight percent oxygen, preferably at least about 95 weight percent oxygen. Such oxygen enriched gas can be manufactured by commercially available cryogenic separation processes.

Oxygen containing gas is introduced into the in situ retort at a rate of about 0.5 to about 10, preferably about 2 to about 6, SCF/min./ft$^2$ superficial velocity in regard to retort cross-sectional area. (SCF is standard cubic feet). The oxygen supports combustion in the retort, generally the combustion of coke on spent shale, but also oil combustion in some cases. The combustion forms off-gases. Steam is commonly added to the oxygen containing gas to dilute oxygen concentration.

It may be desirable to introduce oxygen containing gas intermittently into the retort. When the rate of oxygen introduction is reduced to less than about 25 percent of the normal rate, or stopped, and steam is introduced into the retort, the retort cools somewhat and reduces the steam rate requirement during the normal oxygen containing gas flow period. The steam cools the flame front while advancing hot gases downstream which affect retorting. This operation increases the separation between the flame front and retorting zone and will minimize the amount of oil burned in the flame front.

At least a portion, preferably all of the off-gases from the underground in situ retort are passed to a purification zone to remove hydrocarbons and off-gas impurities which would be detrimental to the environment or operation of downstream equipment.

Often the purification zone removes dust particles from the off-gas. These dust particles can be detrimental to downstream equipment such as compressors, pumps, and the like. Therefore, a portion or all of the off-gas are passed to a dedusting zone wherein the concentration of dust in the off-gases is reduced to a level which would not be detrimental to downstream equipment. The concentration of dust in the off-gas is reduced as far as is technically and economically possible, preferably to less than about 1 grain per cubic foot of gas.

Dedusting can be accomplished a number of ways. The dust can be removed by cyclone separators on the basis of its different density from the gas. Cyclone separators are commonly used to remove small particles from gases or liquids in other processes, for example, petroleum catalytic cracking. Dedusting can also be accomplished by contacting the dust containing gases with a liquid which will remove and entrain the dust. The liquid can then be discarded or regenerated by filtration, distillation or other treating means. For example, when the preferred liquid of water is used, it can be passed to gravity separation, a cyclone type separation, to waste water treatment or for use as process water where the dust would not cause fouling problems or be detrimental to equipment. In some cases, it would be useful to use light hydrocarbons such as distillates, naphthas, and the like to remove dust from the off-gases.

It is generaly desirable to remove a substantial amount of shale oil entrained or vaporized in the off-gases. This removal can be effectuated by passing a portion or preferably all of the off-gas to a deoiling zone wherein a substantial amount of shale oil and easily condensable hydrocarbons entrained in the off-gas are removed. It is preferred to reduce the oil content ($C_4$+ hydrocarbons) to less than about 500 ppm.

A most common method to deoil the off-gas is to compress the gas, thereby liquefying those hydrocarbon components which are easily liquefied. Commonly, water will also be removed from the off-gas during this deoiling step. The compression step is commonly carried out by a multistage compression process with interstage cooling. Generally after compression, the gas mixture is passed to a knock-out drum or an absorber to remove liquids. Commonly, the entrained shale oil is removed by increasing the pressure of the off-gas to at least about 150 psig, preferably about 150 to about 200 psig. Another method of deoiling the off-gas is to scrub the off-gas with a hydrocarbon such as a naphtha fraction wherein the light hydrocarbons in the off-gas are absorbed into the scrubbing hydrocarbon. Still another method of deoiling would be to use refrigeration to cool and condense the liquid hydrocarbon.

The off-gas from in situ retorting commonly contains sulfur compounds, such as hydrogen sulfide, mercaptans, oxides of sulfur, and in some cases carbonyl sulfide. Because many of these can be harmful to equipment, the environment, or downstream processes, the off-gas is purified to substantially reduce the amount of various sulfur compounds. Some sulfur compounds have been removed from the off-gas during deoiling. Other sulfur compounds such as carbonyl sulfide can be hydrogenated or hydrolyzed to hydrogen sulfide. In most instances, the hydrolysis of carbonyl sulfide occurs slowly, however, several methods have been devised for driving the hydrolysis toward completion. Commonly alkaline solutions or moist suspension of heavy metal salts impregnated on solid adsorbents hydrolyze about 85 to about 100 percent of the carbonyl sulfide. In some cases, solutions containing about 0.8 percent sodium aluminate and about 3 percent sodium hydroxide can catalyze the hydrolysis of 85–90 percent of the carbonyl sulfide present, as in U.S. Pat. No. 2,434,868. Other methods of hydrolysis can be found in U.S. Pat. Nos. 2,362,669; 2,362,670; 2,315,662; and 2,315,663. A more complete discussion of the conversion of carbonyl sulfide by hydrogenation of hydrolysis can be found in *Gas Purification,* Second Edition; Riesenfeld, F. C. and Kohl, A. L., Gulf Publishing Company (1974).

Commonly, the hydrolysis is conducted with water and a catalyst such as caustic. One conventional method of removing carbonyl sulfide is by washing with dilute caustic soda. The reaction proceeds in two stages: a slow mass transfer of carbonyl sulphide to the aqueous phase, favored by low caustic strength, followed by hydrolysis to carbon dioxide and hydrogen sulphide, favored a high caustic strength. Since the first reaction is the rate-limiting one, a low concentraton of about 3 percent weight is considered to be the best. It is preferable to reduce the concentration of carbonyl sulfide to as low as is commercially practical, preferably less than about 10 ppm in the off-gas.

Off-gas from in situ retorting commonly contain high concentrations of carbon dioxide. Therefore, before hydrogen sulfide can be treated in a Claus plant, it must be concentrated. One common method of removing hydrogen sulfide from a stream is by extraction with an amine such as monoethanol amine. However, many amines are not very selective and a good separation between hydrogen sulfide and carbon dioxide would be difficult. More selective scrubbing agents such as diisopropyl amine would be preferred.

Hydrogen sulfides can be converted after absorption, for example, by a modified Claus process. Sour gas is fed a reactor furnace with sufficient air to permit ultimate conversion of the $H_2S$ into sulphur plus combustion of any hydrocarbons present. The pressure of the streams is normally in the 5–10 psig range. After combustion, heat is commonly recovered from the reaction gases in a waste-heat boiler. The reaction gases will contain a mixture of $H_2S$, $SO_2$, sulphur and inerts at this point. The main portion of the steam is taken through a condenser or wash tower, cooled and the sulphur is knocked out. Then together with some hot gas, bypass gases are passed through a converter, commonly containing a bauxite catalyst, where $H_2S$ reacts with $SO_2$ for further elemental sulphur production. After further steps of condenser, converter, condenser, the waste gases are incinerated, to oxidize any remaining traces of $H_2S$, and vented from a stack.

Hydrogen sulfide can also be converted by liquid media absorption-air oxidation. The typical process scheme for processes in this category involves absorption of $H_2S$ in a slightly alkaline solution containing oxygen carriers. Regeneration of the solution is by air oxidation. The $H_2S$ is oxidized to elemental sulphur, which is usually collected at the regenerated solution surface as a froth. Filtering or centrifuging permits recovery of a sulphur cake. A variety of alkaline solutions are used depending on the process; some of these are quinone (Stretford process), arsenic-activated potassium carbonate (Giammaco-Vetrocoke process), sodium or ammoniumthioarsenate (Thylox process), aqueous ammonia with hydroquinone (Perox process), and sodium carbonate containing iron oxide in suspension (Ferrox process). The Stretford process is considered quite suitable and most preferred because it is a commercial process and the presence of carbon dioxide does not interfere with its operation. It is preferable to reduce hydrogen sulfide content to less than about 10 ppm, more preferably less than about 2 ppm.

The carbon dioxide content of the gases is desirably reduced to less than about 50 ppm prior to hydrogen recovery. Carbon dioxide can be removed by the Benfield process which uses hot potassium carbonate solution absorption. The process generally operates under a pressure of about 100 psia or higher. Recovered carbon dioxide can be used for enhanced oil recovery.

Hydrogen can be recovered from mixtures with hydrocarbons and other condensible gases by low temperature techniques. After pretreatment to remove high freezing point substances such as water, carbon dioxide, hydrogen sulfide, and the like, the gas is cooled, such as in multistage heat exchangers which will condense hydrocarbons from the hydrogen containing gas. This type of cryogenic separation of hydrocarbon from hydrogen is described in Hydrocarbon Processing, April 1979, page 161, in an article by Petrocarbon Developments Ltd. Feed to the separation zone preferably has less than about 50 ppm $CO_2$ and a dew point less than about minus 80° F. The cold box often can recover 95 weight percent of the hydrogen in the feed at about 90 weight percent purity. The cold box can be operated to recover carbon monoxide, methane, and $C_2+$ if desired. Other methods for hydrogen recovery are the Linde Pressure Swing Absorbtion (PSA) and Monsanto Membrane (PRISM) processes.

Effluent from the cold box commonly contains less than about 20,000 ppm oxygen, less than about 100 ppm water, less than about 2 ppm hydrogen sulfide, and less than about 15 weight percent nitrogen.

Shale oil for contact with hydrogen can be produced in underground in situ retorts or in surface retorts. In the Lurgi type surface retort, raw fresh shale is fed into a mixer wherein it is contacted with hot spent or partially spent shale. The combined oil shales are then fed into a zone for additional residence time. Shale oil which has been retorted from the oil shale is separated from the shale. The oil is recovered and the spent and partially spent shale is passed to a zone wherein carbon is burned off the shale. This can be done by introducing oxygen containing gas such as air or diluted oxygen, and sometimes additional fuel to the zone to combust the carbon. A preferred method is to pass the spent and partially spent shale, and air or air and fuel upwardly through a vertical elongated zone such as a lift pipe. After oxidation, a portion of the spent shale is then removed from the flue gas from said zone, for example by electrostatic precipitators, and used for the manufacture of solid masses. Another portion of the spent shale is fed to the mixer to transfer heat to fresh oil shale. This process is more fully described in U.S. Pat. No. 3,655,518 which is incorporated by reference and made a part hereof.

In fluid bed surface retorting, crushed shale is contacted with hot spent shale and/or hot gases in a fluid bed. The fluid bed may be an elongated vertical zone wherein solids are introduced at or near the bottom and maintained in a fluidized state by high gas velocity. However, fluid bed retort may have many configurations. High temperatures cause oil shale and partially spent oil shale to be formed. Solids are separated from liquid and gaseous products, and partially spent oil shale containing carbonaceous material is passed to a fluidized oxidation zone to burn the carbonaceous material and form spent oil shale relatively free of carbon for recycle or for disposal. Mitchell et al., U.S. Pat. Nos. 4,183,800 and 4,133,739; Tamm et al., U.S. Pat. No. 4,125,453 and Langlois et al., U.S. Pat. No. 4,087,347 are just a few patents which describe fluid bed retorting and are incorporated by reference and made a part hereof.

Other surface retorting processes are TOSCO, Paraho, and Union Oil shale retorting processes.

Shale oil from in situ or surface retorting, or mixtures thereof can be passed to one or more conversion zones for contact with hydrogen and catalyst. Oil can be contacted at hydrotreating conditions with hydrotreating catalyst to substantially remove sulfur and nitrogen from the oil shale. Oil can be contacted at hydrocracking conditions with hydrocracking catalyst to substantially remove sulfur and nitrogen from the oil, and also to crack molcules in the oil into lower boiling material.

One suitable hydrocracking catalyst for the conversion of shale oil is described in Hensley et al., U.S. patent application for a Hydrotreating process, U.S. Ser. No. 181,433 filed Aug. 4, 1980, now U.S. Pat. No. 4,306,965. The catalyst contains a hydrogenation component deposed or deposited upon a porous support. This hydrogenation component comprises chromium, molybdenum, and at least one Group VIII metal from the Periodic Table of Elements. The Periodic Table of Elements referred to herein is the table found on page 628 of WEBSTER'S SEVENTH NEW COLLEGIATE DICTIONARY, G. & C. Merriam Company, Springfield, Mass., U.S.A. (1963). The various metals of the hydrogenation component can be present in the elemental form, as oxides, as sulfides, or as mixtures thereof. The Group VIII metal is preferably nickel or cobalt.

A preferred catalyst contains the metal of Group VIII in an amount which falls within the range of about 0.5 wt% to about 7 wt%, calculated as the oxide of the metal, the molybdenum is present in an amount that falls within the range of about 5 wt% to about 20 wt%, calculated as $MoO_3$, and the chromium in an amount that falls within the range of about 5 wt% to about 15 wt%, calculated as $Cr_2O_3$, each amount being based upon the weight of the catalyst. Preferably, the catalyst should contain the Group VIII metal, preferably cobalt or nickel, in an amount within the range of about 1 wt% to about 4 wt%, calculcated as the oxide of the metal, molybdenum in an amount within the range of about 10 wt% to about 17 wt%, calculated as $MoO_3$, and chromium in an amount within the range of about 8 wt% to about 12 wt%, calculated as $Cr_2O_3$, each amount being based upon the total weight of the catalyst.

An essential component of the support material of the catalyst of the present invention is a crystalline molecular sieve zeolite selected from the group consisting of a faujasite-type crystalline aluminosilicate, a ZSM-type crystalline aluminosilicate, and an AMS-type crystalline metallosilicate. Examples of a faujasitic-type crystalline aluminosilicates are high- and low-alkali metal Y-type crystalline aluminosilicates, metal-exchanged X-type and Y-type crystalline aluminosilicates, and ultrastable, large-pore crystalline aluminosilicate materials. An example of a ZSM-type crystalline aluminosilicate is ZSM-5 crystalline aluminosilicate. AMS-1B crystalline borosilicate is an example of an AMS-type crystalline metallosilicate. One or more of these molecular sieves are suspended in and distributed throughout a matrix of a high-surface area refractory inorganic oxide material. The molecular sieve component is present in an amount within the range of about 5 wt% to about 90 wt%, based upon the weight of the support of the catalyst, which support is made up of the molecular sieve material and the refractory inorganic oxide.

Ultrastable, large-pore crystalline aluminosilicate material is represented by Z-14US zeolites which are described in U.S. Pat. Nos. 3,293,192 and 3,449,070. By large-pore material is meant a material that has pores which are sufficiently large to permit the passage thereinto of benzene molecules and larger molecules and the passage therefrom of reaction products. For use in petroleum hydrocarbon conversion processes, it is often preferred to employ a large-pore molecular sieve material having a pore size of at least 7 to 10 Å.

The ultrastable, large-pore crystalline aluminosilicate material is stable to exposure to elevated temperatures. This stability to elevated temperatures is discussed in the aforementioned U.S. Pat. Nos. 3,293,192 and 3,449,070. It may be demonstrated by a surface area measurement after calcination at 1,725° F. In addition, the ultrastable, large-pore crystalline aluminosilicate material exhibits extremely good stability toward wetting, which is defined as the ability of a particular aluminosilicate material to retain surface area or nitrogen-adsorption capacity after contact with water or water vapor. A sodium-form of the ultrastable, large-pore crystalline aluminosilicate material (about 2.15 wt% sodium) was shown to have a loss in nitrogen-adsorption capacity that is less than 2% per wetting, when tested for stability to wetting by subjecting the material to a number of consecutive cycles, each cycle consisting of a wetting and a drying.

The ultrastable, large-pore crystalline aluminosilicate material that is preferred for the catalytic composition of this invention exhibits a cubic unit cell dimension and hydroxyl infrared bands that distinguish it from other aluminosilicate materials. The cubic unit cell dimension of the preferred ultrastable, large-pore crystalline aluminosilicate is within the range of about 24.20 Angstrom units (Å) to about 24.55 Å. The hydroxyl infrared bands obtained with the preferred ultrastable, large-pore crystalline aluminosilicate material are a band near 3,745 $cm^{-1}$ (3,745±5 $cm^{-1}$), a band near 3,695 $cm^{-1}$ (3,690±10 $cm^{-1}$), and a band near 3,625 $cm^{-1}$ (3,610±15 $cm^{-1}$). The band near 3,745 $cm^{-1}$ (3,690±10 $cm^{-1}$) may be found on many of the hydrogen-form and decationized aluminosilicate materials, but the band near 3,695 $cm^{-1}$ and the band near 3,625 $cm^{-1}$ are characteristic of the preferred ultrastable, large-pore crystalline aluminosilicate material that is used in the catalyst of the present invention.

The ultrastable, large-pore crystalline aluminosilicate material is characterized also by an alkaline metal content of less than 1%.

Other examples of crystalline molecular sieve zeolites that are suitable for the catalyst of the crystalline aluminosilicate such as the sodium-Y molecular sieve designated Catalyst Base 30–200 and obtained from the Linde Division of Union Carbide Corporation and a low-sodium Y molecular sieve designated as low-soda Diuturnal-Y-33-200 and obtained from the Linde Division of Union Carbide Corporation.

Another example of a crystalline molecular sieve zeolite that can be employed in the catalytic composition of the present invention is a metal-exchanged Y-type molecular sieve. Y-type zeolitic molecular sieves are discussed in U.S. Pat. No. 3,130,007. The metal-exchanged Y-type molecular sieve can be prepared by replacing the original cation associated with the molecular sieve by a wide variety of other cations according to techniques that are known in the art. Ion exchange techniques have been disclosed in many patents, several of which are U.S. Pat. Nos. 3,140,249, 3,140,251, and 3,140,253. Specifically, a mixture of rare earth metals can be exchanged into a Y-type zeolitic molecular sieve and such rare earth metal-exchanged Y-type molecular sieve can be employed suitably in the catalytic composition of the present invention. Specific examples of suitable rare earth metals are cerium, lanthanum, and praseodymium.

Another zeolitic molecular sieve material that is used in the catalytic composition of the present invention is ZSM-5 crystalline zeolitic molecular sieves. Descriptions of the ZSM-5 composition and its method of preparation are presented by Argauer, et al., in U.S. Pat. No. 3,702,886.

An additional molecular sieve that can be used in the catalytic composition of the present invention is AMS-1B crystalline borosilicate, which is described in a copending United States Patent application, U.S. Ser. No. 897,360, now U.S. Pat. No. 4,269,813, and in Belgian Pat. No. 859,656.

A suitable AMS-1B crystalline borosilicate is a molecular sieve material having the following composition in terms of mole ratios of oxides:

$$0.9\pm0.2M_{2/n}O:B_2O_3:YSiO_2:ZH_2O,$$

wherein M is at least one cation having a valence of n, Y is within the range of 4 to about 600, and Z is within the range of 0 to about 160, and providing an X-ray diffraction pattern comprising the following X-ray diffraction lines and assigned strengths:

| d (Å) | Assigned Strength |
|---|---|
| 11.2 ± 0.2 | W - VS |
| 10.0 ± 0.2 | W - MS |
| 5.97 ± 0.07 | W - M |
| 3.82 ± 0.05 | VS |
| 3.70 ± 0.05 | MS |
| 3.62 ± 0.05 | M - MS |
| 2.97 ± 0.02 | W - M |
| 1.99 ± 0.02 | VW - M. |

The other essential component of the support material of the catalyst of the present invention is a high-surface area inorganic oxide support, such as alumina, silica, or a mixture of silica and alumina. The mixtures of silica and alumina can include those compositions which are recognized by one having ordinary skill in the art as being a component of fluid cracking catalysts. Such silica-alumina material contains alumina, generally, within the range of about 10 wt% to about 45 wt%.

A preferred high-surface area refractory inorganic oxide is catalytically active alumina, such as gamma-alumina or eta-alumina. Such aluminas have a surface area within the range of about 150 $m^2$/gm to about 350 $m^2$/gm, a pore volume within the range of about 0.3 cc/gm to about 1 cc/gm, and an average pore diameter within the range of about 60 Å (6 nm) to about 200 Å (20 nm).

The catalytic composition of the present invention can be prepared by first making a support material comprising the particular crystalline zeolitic molecular sieve and matrix of a refractory inorganic oxide, such as alumina. This is done by blending finely-divided crystalline molecular sieve in a sol, hydrosol, or hydrogel of the inorganic oxide, adding a gelling medium such as ammonium hydroxide to the blend with constant stirring to produce a gel, drying, pelleting or extruding, and calcining. Drying can be accomplished in static air at a temperature within the range of 80° F. (27° C.) to about 350° F. (177° C.) for a period of time within the range of about 1 hour to about 50 hours. Calcination is performed conveniently by heating in air at a temperature in excess of 800° F. (427° C.) to about 1,200° F. (649° C.) for a period within the range of about 0.5 hour to about 16 hours.

The hydrogenation component can then be incorporated onto the resultant support material by impregnation of the support with one or more solutions of heat-decomposable metal compounds, drying, and calcining as described hereinabove. If impregnation is to be performed with more than one solution, it is preferred that the solution containing the compound of chromium be applied first. However, it is to be understood that the metals can be applied in any order.

The operating conditions for the hydrocracking process comprise a temperature within the range of about 700° F. to about 850° F., preferably about 750° F. to about 850° F., a hydrogen partial pressure within the range of about 1,000 psia (6,890 kPa) to about 2,500 psia (17,225 kPa), a liquid hourly space velocity (LHSV) within the range of about 0.1 volume unit of hydrocarbon per hour per volume unit of catalyst to about 5 volume units of hydrocarbon per hour per volume unit of catalyst, a hydrogen addition or hydrogen recycle rate within the range of about 2,000 standard cubic feet of hydrogen per barrel of hydrocarbon (SCFB) to about 20,000 SCFB, and a hydrogen-to-hydrocarbon molar ratio within the range of about 3 to about 60 moles of hydrogen per mole of hydrocarbon.

Hydrotreating catalyst and operating conditions are discussed in Gorring et al., U.S. Pat. No. 4,153,540 which is hereby incorporated by reference and made a part hereof. The catalysts generally comprise a metal or combination of metals having hydrogenation/dehydrogenation activity on a relatively inert refractory. Suitable metals are nickel, cobalt, molybdenum, tungsten, vanadium, and chromium, often in combination such as cobalt-molybdenum, and nickel-cobalt-molybdenum. The refractory may be large pore alumina, zirconia-titania, or other porous refractories; and/or zeolites such as ZSM-5 and the like. A preferred catalyst comprises nickel-molybdenum or nickel-tungsten on silica-alumina.

The operating conditions for the hydrotreating process comprise a temperature within the range of about 700° F. to about 850° F., a hydrogen partial pressure within the range of about 1,000 psia (6,890 kPa) to about 2,500 psia (17,225 kPa), a liquid hourly space velocity (LHSV) within the range of about 0.1 volume unit of hydrocarbon per hour per volume unit of catalyst to about 5 volume units of hydrogen per hour per volume unit of catalyst, and a hydrogen addition or hydrogen recycle rate within the range of about 2,000 standard cubic feet of hydrogen per barrel of hydrocarbon (SCFB) to about 20,000 SCFB. Hydrotreating and hydrocracking conditions can be varied to achieve the desired product, especially the desired sulfur and nitrogen levels.

Because shale oil often contains arsenic, a guard chamber is generally required to protect downstream catalysts from deactivation. Suitable catalysts for arsenic removal comprise high surface area alumina, bauxite, spent hydrotreating or hydrocracking catalyst, and others. Temperatures in excess of about 600° F. and hydrogen partial pressures above about 400 psia are adequate for removal of most arsenic. This process is more fully discussed in U.S. Pat. No. 4,141,820 which is hereby incorporated by reference and made a part hereof.

THE DRAWING

The drawing is a schematic diagram of one embodiment of this invention.

Underground in situ retort 1 is located within oil shale formation 2. The in situ retort has been formed by the limited removal of a portion of the oil shale and explosive expansion of other oil shale so as to form a retort substantially filled with rubblized matter comprising oil shale. The retort has a sloping bottom which leads to a separation zone 3 wherein gas, oil and water 70 can be separated by gravity. Air 4 is passed from the atmosphere into cryogenic separation zone 5 which separates air into its substantial component parts of nitrogen and oxygen. An oxygen stream of at least about 90 percent by weight oxygen is passed through line 6 to support combustion within in situ retort 1. Additionally, diluent gas such as steam, combustion off-gases, carbon dioxide, and the like 7 can be passed through line 8 in order to provide the proper dilution of the oxygen stream to form a suitable gas for in situ combustion. Combustion within retort 1 provides hot gases which heat the oil shale to retorting temperature, thereby forming gases, oil and water. The off-gas from retort 1 is a complex mixture of gases from combustion and from retorting and contains hydrocarbons such as methane, ethane, ethene, propane, propene, butane, butene, and like. The off-gas also contains hydrogen, carbon dioxide, nitrogen, carbon monoxide, hydrogen sulfide, carbonyl sulfide, and others. The off-gas is substantially separated from oil and water within separation zone 3 and passed through line 9 to compressor 10 where the gas is compressed to about 160 psia. Some hydrocarbons, water and particulates will be thereby separated from the gas and after passage through line 11 and knock out drum 12 will pass through line 13 to oil recovery and water and dust disposal 14. The gas leaving knock out drum 12 will have an oil content less than about 10,000 ppm, a water content less than 15,000 ppm, and a solids particulate content less than about 10 ppm. The gas is then passed through line 15 to a hydrogen sulfide removal means 16, a Stretford unit which reduces hydrogen sulfide content to less than 1 ppm. The hydrogen sulfide is oxidized to elemental sulfur and passed through line 17 for recovery 18. Off-gas is then passed through line 19 to a carbon dioxide removal means 20. This Benfield unit operates at a pressure of about 100 psia and reduces the carbon dioxide content to less than 50 ppm. The separated carbon dioxide is passed through line 21 for recovery 22. This carbon dioxide can be used as a diluent for retorting or possibly for use in enhanced oil recovery. The carbon dioxide content is reduced primarily to enhance the operation of the downstream hydrogen removal means cold box. After compression to about 500 psia, the off-gas is then passed through line 23 to hydrogen separation zone 24 which comprises a cold box which substantially separates hydrogen from the other gases present. The cold box recovers about 95 wt% of the hydrogen in the feed at about 90 wt% purity. Hydrogen is passed on through line 25 while the other off-gas, substantially enriched in hydrocarbons, passes through line 26 for combustion as a fuel gas in a power plant or possibly for use in additional hydrogen generation in hydrogen plant 27. The off-gas hydrocarbon stream from the cold box and/or a natural gas stream 28 can be passed into hydrogen plant 27 for generation of additional hydrogen. The hydrogen is passed through line 29 for combination with hydrogen from line 25 and then passed on through line 30 to the hydrogen conversion zones.

Oil from in situ retort 1 and separation zone 3 is passed through line 31 to distillation zone 32 where it is separated into light and heavy fractions. The light fraction boils in the range of about 200° F. to about 650° F. and the heavy fraction boils in the range of about 650° to about 1000° F. The light oil is passed through line 33 and the heavy oil is passed through line 34 from distillation zone 32.

Oil shale which has been mined and brought to the surface 35 is passed through line 36 into a surface retorting zone 37. Surface retorting zone 37 is preferably a Lurgi type retort or a fluid bed type surface retort. The oil shale is retorted to form a mixture of gases and oil. These gases and oils can be separated because of their difference in boiling point and can be removed from retorting zone 37. Gases are passed through line 38. Light oils, boiling in the range from about 200 to about 650° F. are passed through line 39, and heavy oils boiling in the range of about 650 to about 1100° F. are passed through line 40 for passage to a hydrogen conversion zone.

Light oil from lines 33 and 39 are combined and passed through line 41 where hydrogen is introduced through line 42 prior to entry of the mixture of light oil and hydrogen into guard reactor 43. Guard reactor 43 is a reaction zone to remove arsenic materials from the oil and prevent the deactivation of downstream catalysts. The guard reactor commonly contains a catalyst comprising alumina and is operated at a temperature from about 650° to about 800° F. and a hydrogen partial pressure of about 1300 to about 1800 psia. The light oil feed and hydrogen from guard reactor 43 are passed through line 44 to hydrotreating zone 45 where the oil is contacted with hydrogen and catalyst at hydrotreating conditions. The hydrotreating catalyst comprises nickel-molybdenum on large-pore alumina and the hydrotreating conditions comprise a temperature of about 650° to about 850° F. and a hydrogen partial pressure of about 1000 to about 2000 psia. The oil passing from hydrotreating zone 46 generally contains less than about 0.1 wt.% sulfur and less than about 0.3 wt% nitrogen.

Heavy oil from lines 34 and 40 is passed through line 47 where it is contacted with hydrogen from line 48. Hydrogen can also be introduced from hydrotreater 45 through line 49. The mixture of heavy oil and hydrogen is passed into guard reactor 50 where it is contacted with catalyst to remove arsenic materials. The guard reactor contains a catalyst comprising alumina and is operated at a temperature of about 650° to about 850° F. and a hydrogen partial pressure of about 1500 to about 1900 psia. The oil from guard reactor 50 is passed through line 51 to hydrocracking zone 52 where the oil is contacted with hydrogen and catalyst at hydrocracking conditions. The catalyst comprises chromium-molybdenum-cobalt on a large-pore molecular sieve. The temperature can be about 650° to about 850° F. and the hydrogen partial pressure can be about 1500 to about 1900 psia. Oil from hydrocracking zone 52 passes through line 53 and has a sulfur content less than about 0.1 wt% and a nitrogen content less than about 0.3 wt%. The hydrocracking zone has substantially reduced the average molecular weight of the oil. $C_3$ minus from the hydrogen conversion zones may be used for plant fuel.

The following table shows typical inspections of the same shale oil feed subjected to hydrotreating and hydrocracking:

| | Raw | Hydro-treated | Hydro-cracked |
|---|---|---|---|
| nitrogen | 2.0 wt % | 100 ppm | 10 ppm |
| sulfur | 0.7 wt % | 10 ppm | 10 ppm |
| oxygen | 1.3 wt % | <50 ppm | <50 ppm |
| $C_5$-360° F. | 10 wt % | 25 wt % | 40 wt % |
| 360°-650° F. | 45 wt % | 60 wt % | 55 wt % |

-continued

| | Raw | Hydro-treated | Hydro-cracked |
|---|---|---|---|
| 650°-1000° F. | 40 wt % | 30 wt % | 5 wt % |
| 1000°+ F. | 5 wt % | 0 | 0 |
| Hydrogen Consump. | — | 1300 SCFB | 1500 SCFB |
| Gravity, °API | 25 | 40 | 47 |

We claim:

1. A method for processing oil shale, comprising the steps of:

establishing an underground in situ retort containing a mass of rubblized matter comprising oil shale;

establishing a flame front within said mass of oil shale to liberate water and shale oil containing arsenic, nitrogen and sulfur from said oil shale and form combustion off-gases containing hydrogen, sulfur, carbon dioxide and shale oil;

passing a gaseous mixture of oxygen and a diluent selected from the group consisting of steam, carbon dioxide and combustion off-gases into said underground retort to support said flame front;

withdrawing said shale oil, water and combustion off-gases from said underground retort;

substantially separating said withdrawn shale oil, water and combustion off-gases in an underground separation zone;

deoiling said combustion off-gases in a deoiling zone to remove a substantial amount of said shale oil from said combustion off-gases;

desulfurizing said combustion off-gases to remove a substantial amount of said sulfur from said combustion off-gases;

removing a substantial amount of said carbon dioxide from said combustion off-gases;

recovering a substantially purified gas stream of hydrogen from said combustion off-gases;

separating said shale oil from said underground retort into fractions including a fraction of light shale oil and a fraction of heavy shale oil;

injecting a portion of said purified gas stream of hydrogen into said fraction of light shale oil;

injecting another portion of said purified gas stream of hydrogen into said fraction of heavy oil;

removing a substantial amount of said arsenic from said fraction of light shale oil in a first reactor;

removing a substantial amount of said arsenic from said fraction of heavy shale oil in a second reactor;

hydrotreating said fraction of light shale oil and removing a substantial amount of said nitrogen and said sulfur from said fraction of light shale oil in a hydrotreating zone; and hydrocracking said fraction of heavy shale oil and removing a substantial amount of said nitrogen and said sulfur from said fraction of heavy shale oil in a hydrocracking zone.

2. The method of claim 1 wherein said gaseous mixture is formed from a diluent stream and a separate stream of oxygen containing gas comprising at least 90 weight percent oxygen.

3. The method of claim 1 wherein the purified gas stream comprises less than about 20,000 ppm oxygen, less than about 15 weight percent nitrogen, less than about 1 ppm carbon dioxide, less than about 100 ppm water, and less than about 2 ppm hydrogen sulfide.

4. The method of claim 1 wherein said hydrotreated light shale oil and said hydrocracked heavy shale oil each contain less than about 0.1 weight percent sulfur and less than about 0.3 weight percent nitrogen.

5. The method of claim 1 including retorting raw oil shale in a surface retort above ground to liberate shale oil containing arsenic, nitrogen and sulfur;

combining a fraction of light shale oil obtained from said surface retort with said fraction of light shale oil obtained from said underground retort;

injecting hydrogen, removing arsenic, hydrotreating and removing nitrogen and sulfur from said fraction of light shale oil obtained from said surface retort along with said fraction of light shale oil obtained from said underground retort;

combining a fraction of heavy shale oil obtained from said surface retort with said fraction of heavy shale oil obtained from said underground retort; and injecting hydrogen, removing arsenic, hydrocracking and removing nitrogen and sulfur from said fraction of heavy shale oil obtained from said surface retort along with said fraction of heavy shale oil obtained from said underground retort.

6. A method for processing oil shale, comprising the steps of:

establishing a flame front in an underground retort containing a rubblized mass of oil shale;

liberating shale oil and water from said oil shale with heat generated from said flame front;

emitting combustion off-gases from said flame front;

feeding an oxygen containing gas consisting essentially of 90% by weight oxygen into said retort to support said flame front;

stopping feeding of said oxygen containing gas;

injecting steam into said retort after said feeding is stopped for minimizing burning of said shale oil; and withdrawing said shale oil, water and combustion off-gases from said retort.

7. The metod of claim 6 wherein:

said shale oil contains arsenic, nitrogen and sulfur;

said combustion off-gases contain hydrogen;

said shale oil, water and combustion off-gases are substantially separated in an underground separation zone;

a substantially purified stream of hydrogen is removed from said combustion off-gases;

said purified stream of hydrogen is injected into said shale oil;

a substantial amount of said arsenic is removed from said hydrogenated shale oil; and thereafter said hydrogenated shale oil is hydrotreated to remove a substantial amount of said nitrogen and said sulfur from said shale oil.

8. The method of claim 7 including hydrocracking part of said hydrogenated shale oil.

9. The method of claim 7 including removing shale oil, sulfur and carbon dioxide from said combustion off-gases before said purified stream of hydrogen is removed.

* * * * *

UNITED STATES PATENT OFFICE
CERTIFICATE OF CORRECTION

Patent No. 4,353,418 Dated October 12, 1982

Inventor(s) Hoekstra, Gerald B. and Christian, David R.

It is certified that error appears in the above-identified patent and that said Letters Patent are hereby corrected as shown below:

Cover Page

Item [73] Assignees:"Standard Oil Company (Indiana); Gulf Oil Corporation, both of Chicago, Illinois" should be -- Standard Oil Company, Chicago, Illinois, Gulf Oil Corporation, Pittsburgh, Pa.--

Signed and Sealed this

Seventh Day of February 1984

[SEAL]

Attest:

GERALD J. MOSSINGHOFF

Attesting Officer

Commissioner of Patents and Trademarks